US006899384B1

(12) United States Patent
Tseng

(10) Patent No.: US 6,899,384 B1
(45) Date of Patent: May 31, 2005

(54) FOLDABLE CHAIR ASSEMBLY

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/810,014

(22) Filed: Mar. 26, 2004

(51) Int. Cl.[7] ..... A47C 4/00
(52) U.S. Cl. ..... 297/46; 297/16.1; 297/51; 297/53; 297/34
(58) Field of Search ..... 297/46, 50, 51, 297/55, 56, 59, 16.1, 31, 53

(56) References Cited

U.S. PATENT DOCUMENTS 169,015 A * 10/1875 McAleer ..... 297/34
2,652,884 A * 9/1953 Barsness ..... 297/34
5,730,489 A * 3/1998 Eberle et al. ..... 297/53

FOREIGN PATENT DOCUMENTS

EP 291433 A1 * 11/1988 ..... A47C 4/14
FR 2604075 A1 * 3/1988 ..... A47C 4/14

* cited by examiner

*Primary Examiner*—Anthony D. Barfield
(74) *Attorney, Agent, or Firm*—Ladas & Parry LLP

(57) ABSTRACT

A foldable chair assembly includes a seat frame, a backrest pivoted to the seat frame, a rear leg pivoted to the backrest, and a front leg pivoted to the rear leg and the seat frame. When the chair assembly is folded, the seat frame, the backrest, and the front and rear legs lie substantially in the same plane in such a manner that the seat frame extends within the backrest, the backrest extends within the rear leg, and the rear leg extends within the front leg.

8 Claims, 8 Drawing Sheets

FOLDABLE CHAIR ASSEMBLY

BACKGROUND OF THE INVENTION

1. Field of the Invention

The invention relates to a chair assembly, more particularly to a foldable chair assembly.

2. Description of the Related Art

Referring to FIGS. 1 and 2, a conventional foldable chair assembly 1 is shown to include left and right armrests 11 (only one is visible in FIG. 1), a front leg 13 connected pivotally to the armrests 11 at a front portion thereof through left and right first pivot pins 12 (only one is visible in FIG. 1), a rear leg 15 connected pivotally to the armrests 11 at a rear portion thereof through left and right second pivot pins 14 (only one is visible in FIG. 1), a seat frame 16 connected to the front and rear legs 13, 15, a backrest 17, and left and right connecting plates 18 (only one is visible in FIG. 1). The seat frame 16 is connected to the front leg 13 through two third pivot pins 161, and has a rear end portion connected to the connecting plates 18 through left and right fourth pivot pins 162. The backrest 17 is connected to the armrests 11 at a location proximate to a central portion thereof through two fifth pivot pins 171, and is connected to the connecting plates 18 at a bottom end portion thereof through two sixth pivot pins 172. The connecting plates 18 are further connected to the rear leg 15 through left and right seventh pivot pins 181. Each of the front leg 13, the rear leg 15, the seat frame 16, and the backrest 17 is substantially U-shape or H-shape. Since the structures of the front and rear legs 13, 15, the seat frame 16, and the backrest 17 are not pertinent to the present invention, a detailed description of the same will be dispensed with herein for the sake of brevity.

When the chair assembly 1 is in an unfolded state, as shown in FIG. 1, the armrests 11 are supported by the front and rear legs 13, 15, while the seat frame 16 and the backrest 17 maintain therebetween an angle greater than 90 degrees. To fold the chair assembly 1, the backrest 17 is pushed frontwardly. At this time, the armrests 11 and the connecting plates 18 move simultaneously so that the backrest 17 and the seat frame 16 are moved toward each other between the armrests 11, and the front and rear legs 13, 15 lean against each other and move rearwardly to the rear and lower side of the armrests 11, thereby folding the chair assembly 1 to a folded state shown in FIG. 2.

Although the conventional foldable chair assembly 1 can achieve its intended purpose of reducing packaging and storage space requirements, in actual use, after folding the conventional foldable chair assembly 1, the chair assembly 1 still occupies a substantially large volume because the front and rear legs 13, 15 lie one over the other and because the seat frame 16 and the backrest 17 protrude from the folded front and rear legs 13, 15.

SUMMARY OF THE INVENTION

Therefore, the object of the present invention is to provide a foldable chair assembly that is capable of overcoming the aforementioned drawback of the prior art.

According to this invention, a foldable chair assembly comprises a seat frame, a backrest, a rear leg, a front leg, a pair of pivot units, and two connecting units. The seat frame includes left and right side sections, and has a first width measured in a direction transverse to the left and right side sections. The backrest includes left and right side sections which are pivoted respectively to the left and right side sections of the seat frame. The backrest has a second width measured in a direction transverse to the left and right side sections of the backrest. The rear leg includes left and right side sections which are pivoted respectively to the left and right side sections of the backrest. The rear leg has a third width measured in a direction transverse to the left and right side sections of the rear leg. The front leg includes left and right side sections which are pivoted respectively to the left and right side sections of the rear leg and the left and right side sections of the seat frame. The front leg has a fourth width measured in a direction transverse to the left and right side sections of the front leg. Each of the pivot units interconnects one of the left and right side sections of the backrest and one of the left and right side sections of the rear leg. Each of the connecting units includes a pivot portion connected between a respective one of the left and right side sections of the seat frame and a respective one of the left and right side sections of the front leg, and a connecting plate connected to the pivot portion. The connecting plate has an elongated slot to permit one of the pivot units to extend therethrough and to slide therewithin. When the chair assembly is folded, the seat frame, the backrest, and the front and rear legs lie substantially in the same plane.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
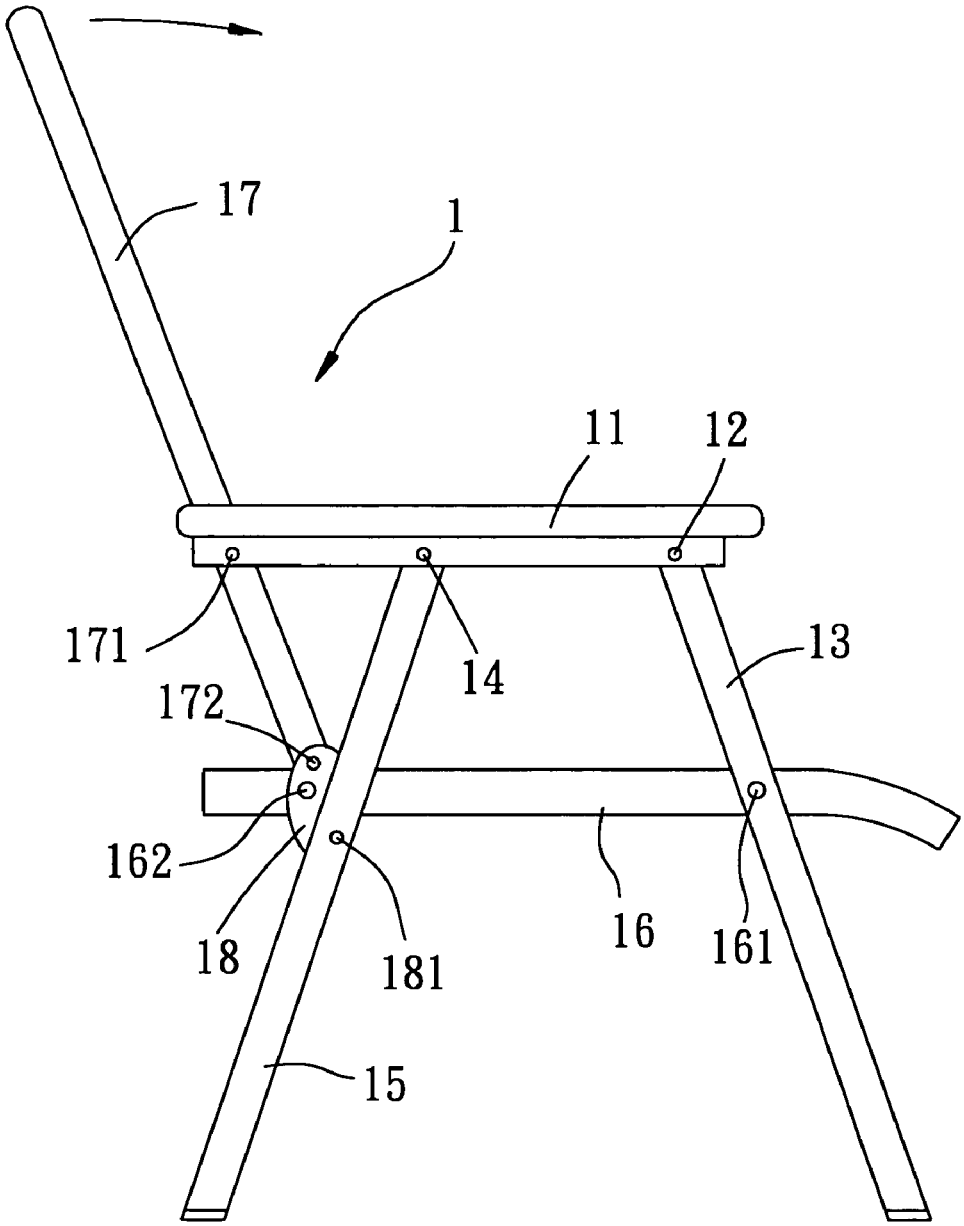
FIG. 1 PRIOR ART
FIG. 1 is a schematic side view of a conventional foldable chair assembly in an unfolded state.
Figure 2:
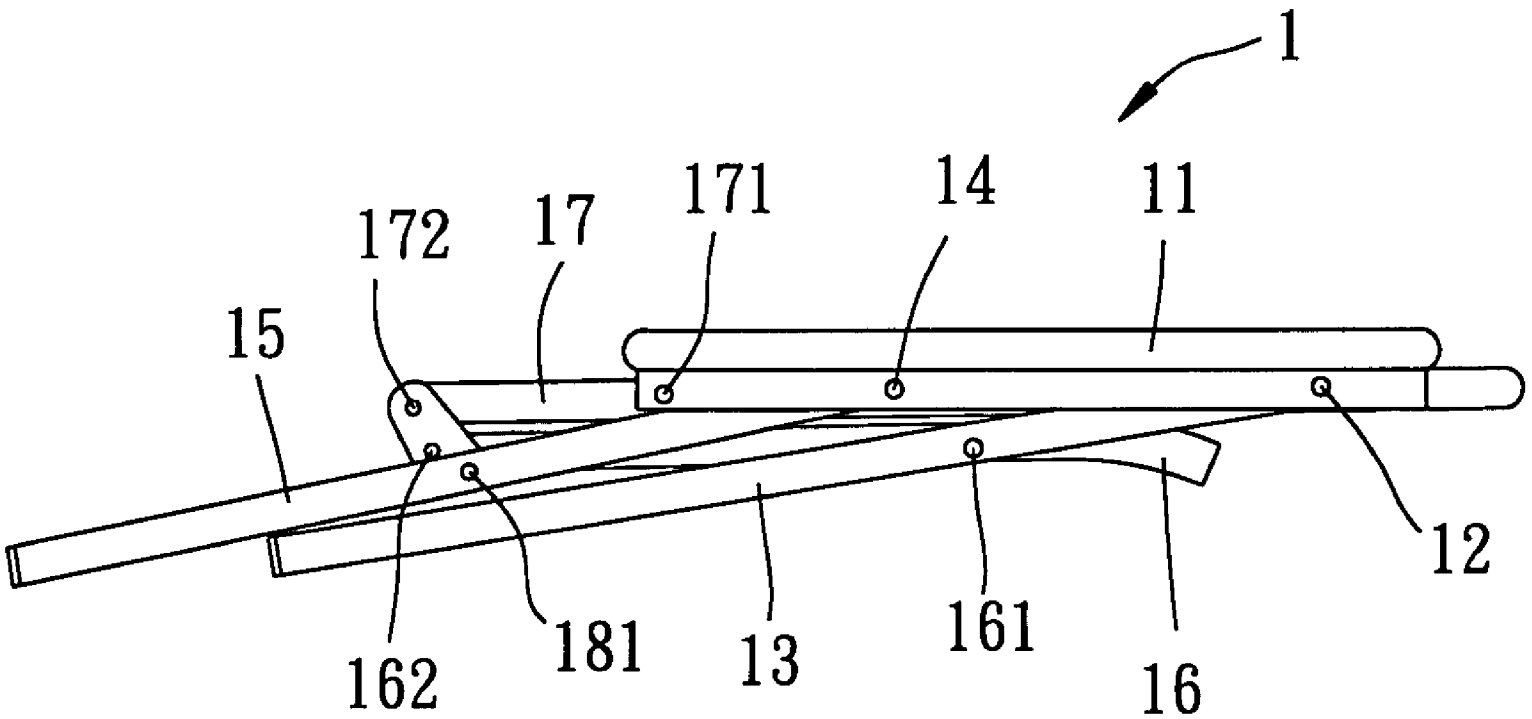
FIG. 2 PRIOR ART
FIG. 2 is a schematic view of the conventional foldable chair assembly in a folded state.
Figure 3:
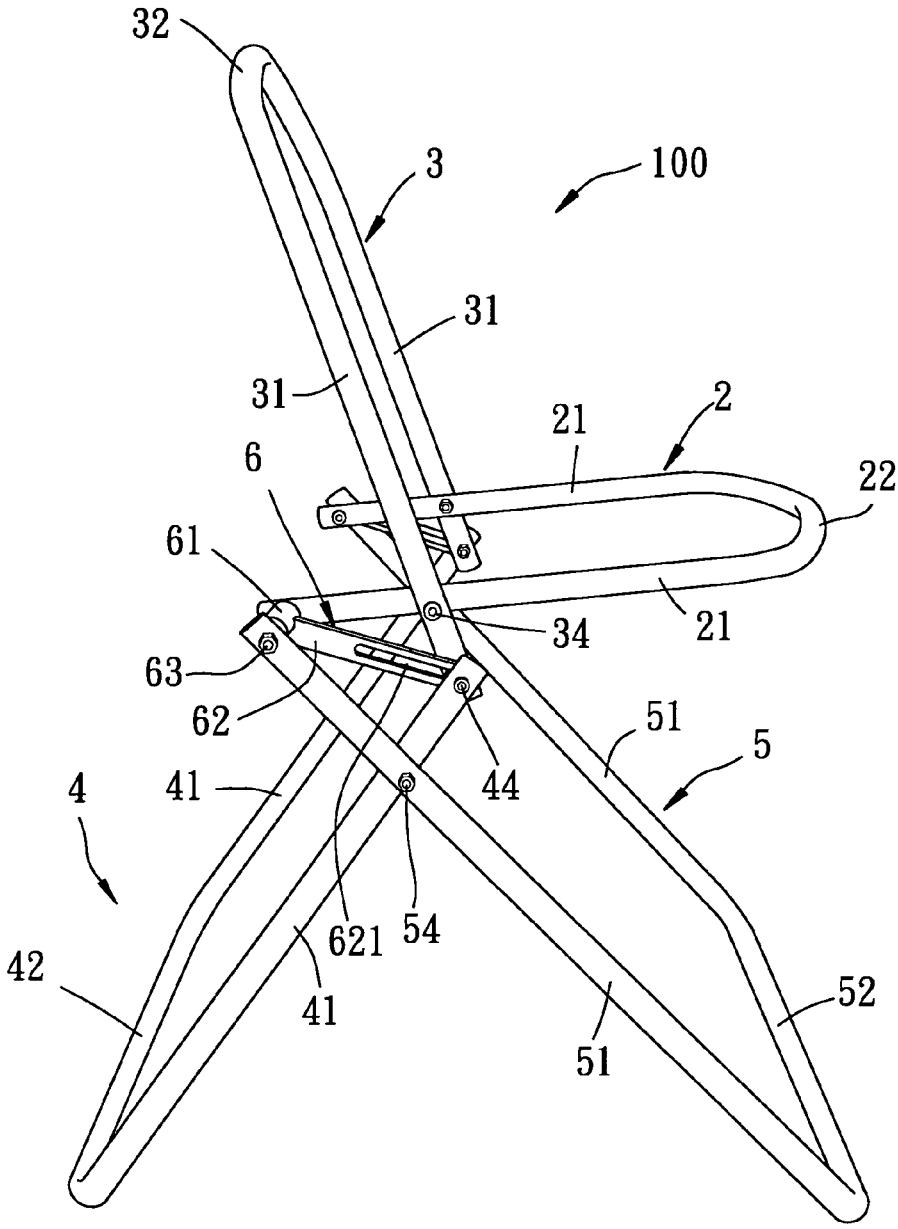
FIG. 3 is a perspective view of the preferred embodiment of a foldable chair assembly according to the present invention.
Figure 4:
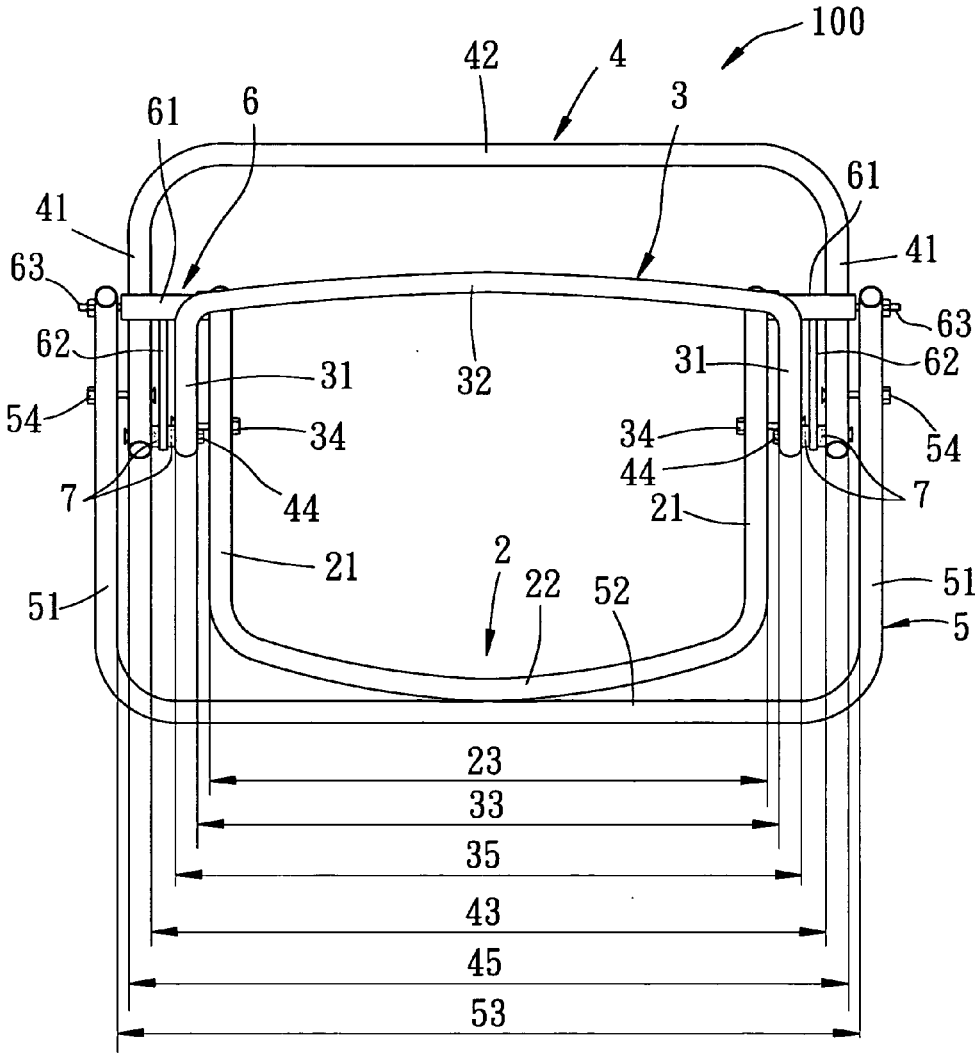
FIG. 4 is a schematic top view of the preferred embodiment.

Referring to FIGS. 3 and 4, the preferred embodiment of a foldable chair assembly 100 according to the present invention is shown to comprise a seat frame 2, a backrest 3, a rear leg 4, a front leg 5, two connecting units 6, and two pairs of cushion pieces 7.

The seat frame 2 is substantially U-shaped, and includes left and right side sections 21 which have front and rear ends, and an intermediate section 22 interconnecting the front ends of the side sections 21. The seat frame 2 has a first width 23 measured in a direction transverse to the left and right side sections.

The backrest 3 is substantially U-shaped, and includes left and right side sections 31 which have top and bottom ends, and an intermediate section 32 interconnecting the top ends of the side sections 31. The backrest 3 has a second width 33 measured in a direction transverse to the left and right side sections 31 of the backrest 3. The second width 33 is greater than the first width 23. The side sections 31 of the backrest 3 are connected respectively and pivotally to the side sections 21 of the seat frame 2 through a pair of first pivot units 34. Each of the first pivot units 34 is disposed between the front and rear ends of a respective side section 21 of the seat frame 2.

The rear leg 4 is substantially u-shaped, and includes left and right side sections 41 which have top and bottom ends, and an intermediate section 42 interconnecting the bottom ends of the side sections 41. The rear leg 4 has a third width 43 measured in a direction transverse to the left and right side sections 41 of the rear leg 4. The third width 43 is greater than the width 35 measured from outer sides of the side sections 31 of the backrest 3. The bottom ends of the side sections 31 of the backrest 3 are connected respectively and pivotally to the top ends of the side sections 41 of the rear leg 4 through a pair of second pivot units 44. Each of the second pivot units 44 is located proximate to the top end of a corresponding side section 41 of the rear leg 4 and proximate to the bottom end of a corresponding side section 31 of the backrest 3.

The front leg 5 is substantially U-shaped, and includes left and right side sections 51 which have top and bottom ends, and an intermediate section 52 interconnecting the bottom ends of the side sections 51. The front leg 5 has a fourth width 53 measured in a direction transverse to the left and right side sections 51 of the front leg 5. The fourth width 53 is greater than the width 45 measured from outer sides of the side sections 41 of the rear leg 4. The side sections 51 of the front leg 5 are connected respectively and pivotally to the side sections 41 of the rear leg 4 through a pair of third pivot units 54. Each of the third pivot units 54 is disposed below the top end of the corresponding side section 51 of the front leg 5 and below the top end of the corresponding side section 41 of the rear leg 4.

Figure 5:
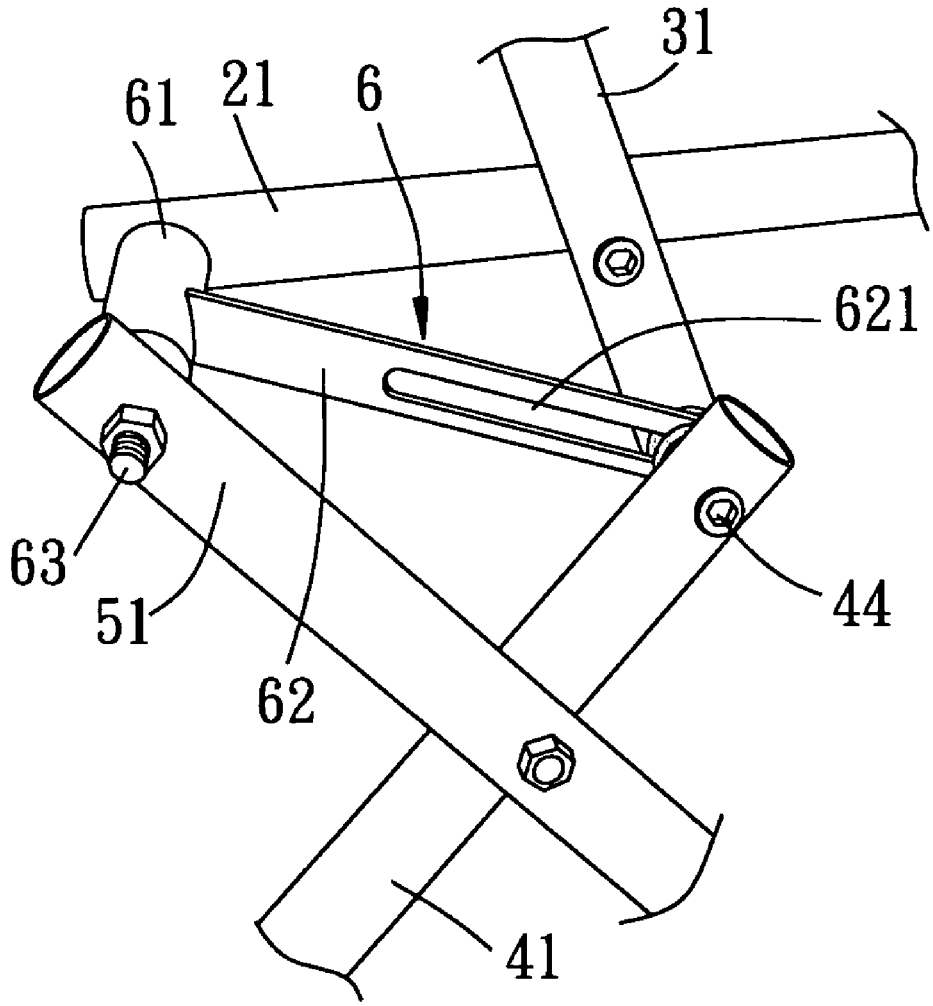
FIG. 5 is a fragmentary enlarged perspective view to illustrate a connecting unit of the preferred embodiment.

Referring to FIG. 5, in combination with FIGS. 3 and 4, each of the connecting units 6 includes a tubular pivot portion 61, and a connecting plate 62 welded to the pivot portion 61 and extending frontwardly and inclinedly relative to the pivot portion 61. Each pivot portion 61 is connected pivotally between the rear end of the respective side section 21 of the seat frame 2 and the top end of the respective side section 51 of the front leg 5 through a fourth pivot unit 63. Each connecting plate 62 has an elongated slot 621 that extends along the length of the connecting plate 62. Each of the second pivot units 44, aside from connecting pivotally the side sections 31, 41 of the backrest 3 and the rear leg 4, further extends through the slot 621, and is slidable along the slot 621 in the corresponding connecting plate 62. The cushion pieces 7 (see FIG. 4) in each pair are mounted on one of the second pivot units 44 on two sides of the connecting plate 62 of the respective connecting unit 6.

Figure 6:
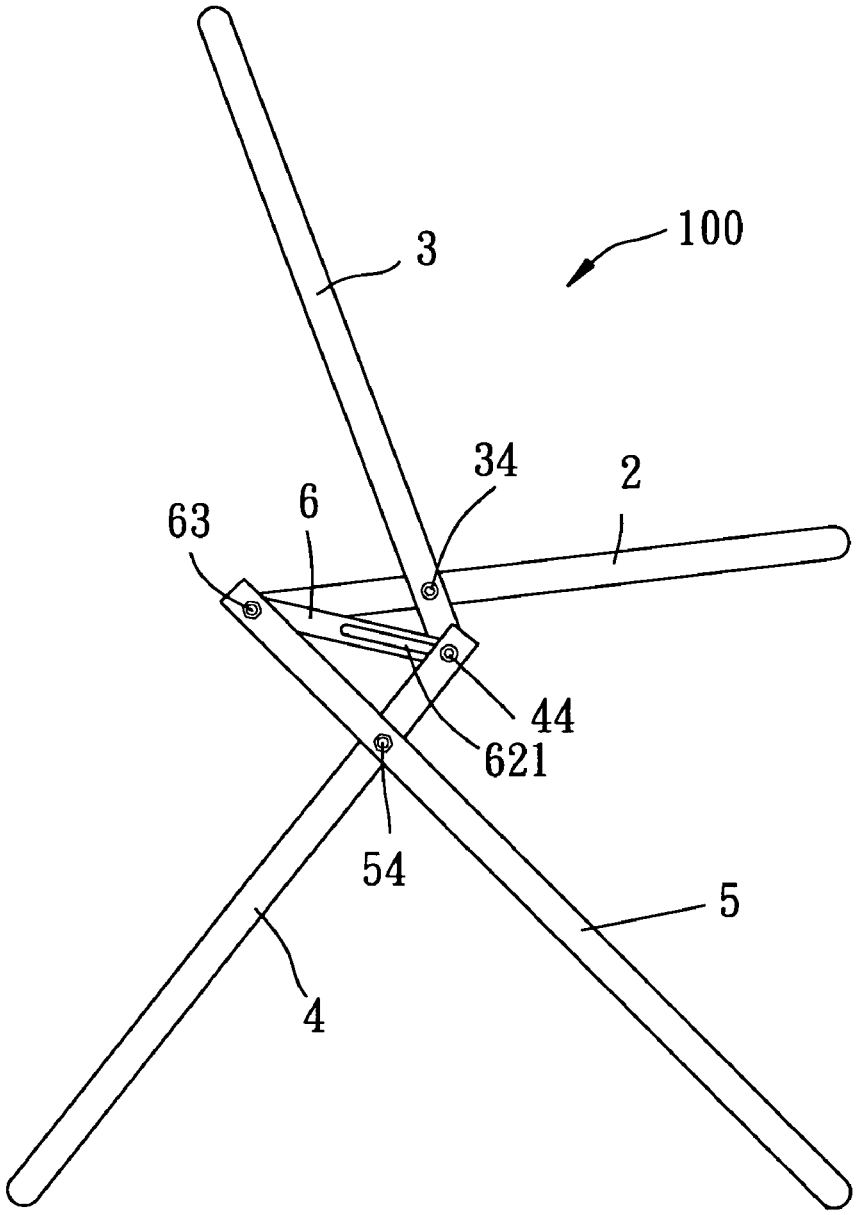
FIG. 6 is a schematic side view of the preferred embodiment in an unfolded state.

Referring to FIG. 6, the foldable chair assembly 100 of the present invention is shown in an unfolded state. The bottom ends of the front and rear legs 4, 5 are spaced apart from each other with a maximum distance. The seat frame 2 and the backrest 3 maintain therebetween an angle slightly greater than 90 degrees so as to facilitate sitting of a user. The second pivot units 44 are located respectively at the front ends of the slots 621 at this time.

Figure 7:
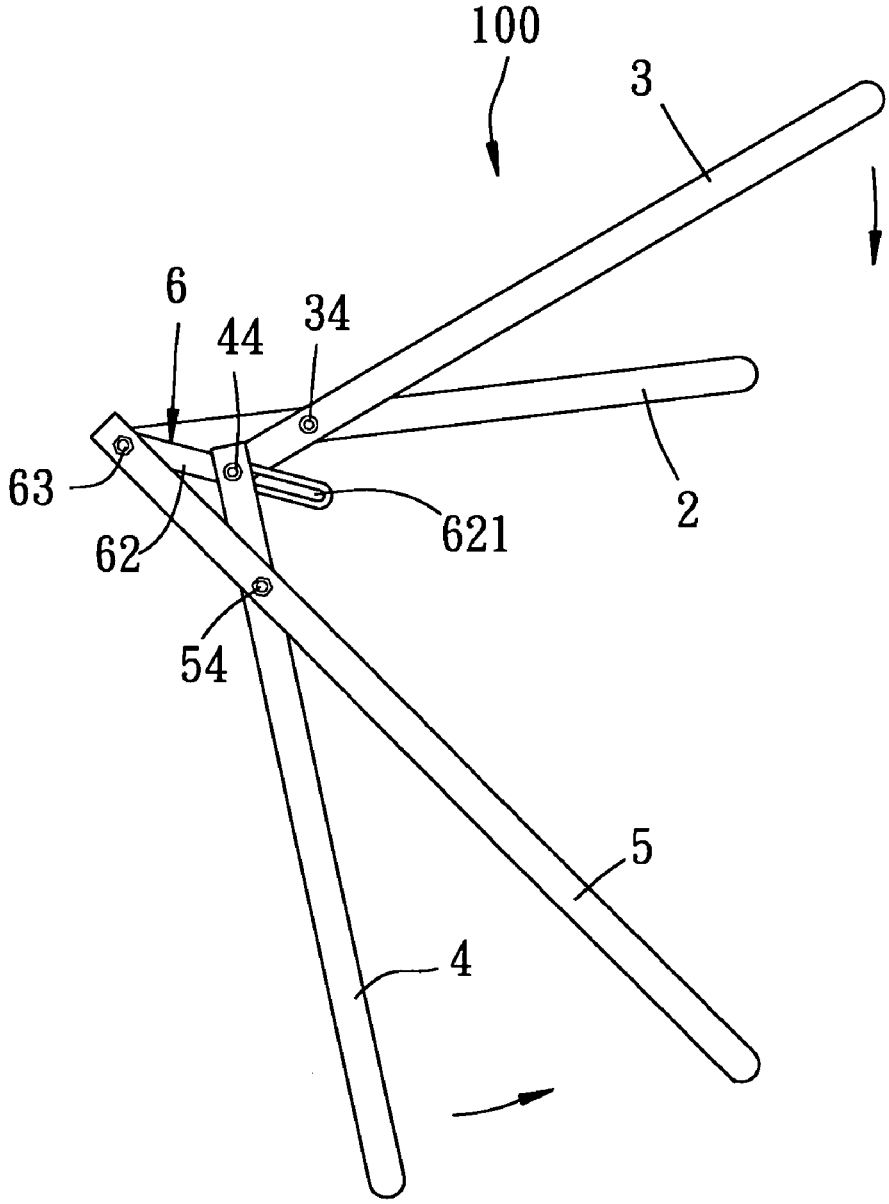
FIG. 7 is a view similar to FIG. 6, but illustrating a folding operation of the preferred embodiment.
Figure 8:
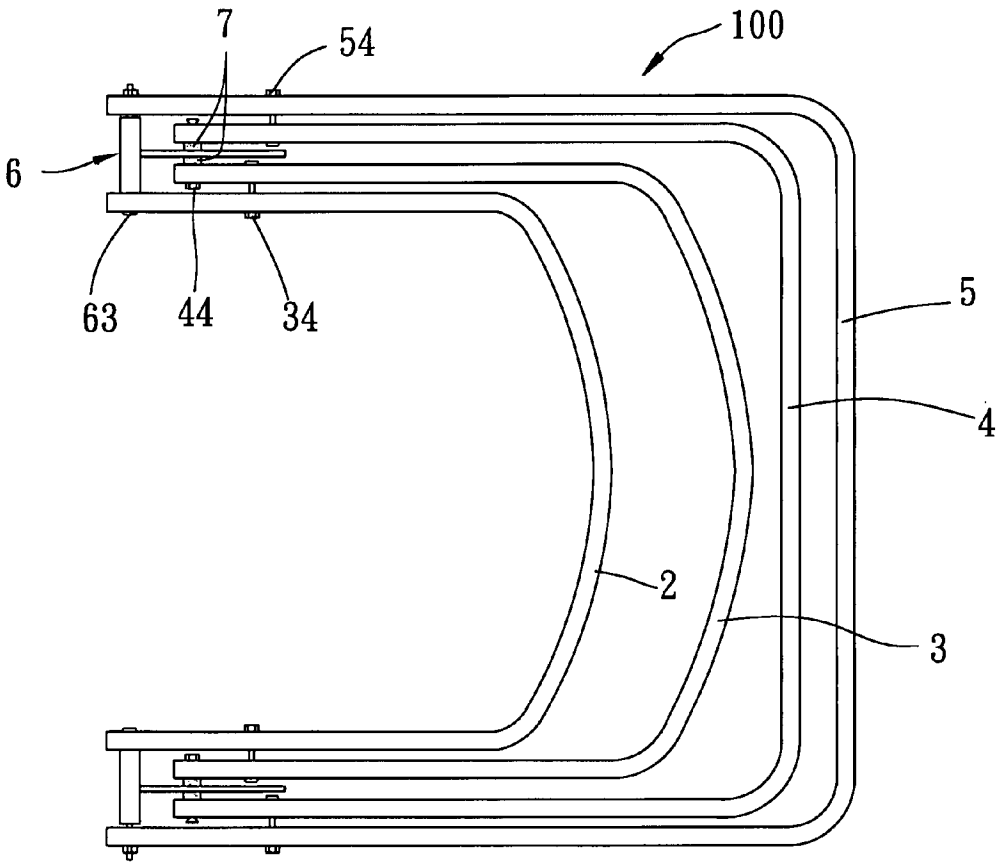
FIG. 8 is a schematic view of the preferred embodiment in a folded state.

Referring to FIG. 7, in combination with FIG. 3, to fold the foldable chair assembly 100 of the present invention, the intermediate section 32 of the backrest 3 is pushed frontwardly so that the bottom ends of the side sections 31 of the backrest 3 pivot rearwardly relative to the first pivot unit 34. Since the bottom ends of the side sections 31 of the backrest 3 are pivoted to the rear ends of the side sections 21 of the seat frame 2 through the second pivot units 44, and since the second pivot units 44 extend through the respective slots 621 in the connecting units 6 and the top ends of the side sections 41 of the rear leg 4, when the backrest 3 is folded, the top ends of the rear leg 4 will move rearwardly, and the bottom ends of the rear leg 4 will turn frontwardly about the third pivot units 54. When the second pivot units 44 slide to the rear ends of the slots 621, the rear leg 4, which intersects initially the front leg 5, will now extend in a direction similar to the front leg 5, and the backrest 3, which initially inclines rearwardly, will now extend frontwardly. When the seat frame 2, the backrest 3, and the front and rear legs 5, 4 lie on the same plane, the chair assembly 100 is in a folded state, as shown in FIG. 8. In the folded state, the seat frame 2 extends within the backrest 3, the backrest 3 extends within the rear leg 4, and the rear leg 4 extends within the front leg 5.

In this embodiment, each of the pivot units 34, 44, 54 and 63 is constituted by a screw and a nut. Alternatively, they may be replaced with rivets or any other suitable pivot fasteners. Each of the seat frame 2, the backrest 3, the front leg 5, and the rear leg 4 can be an H-shape or any other shape aside from the U-shape.

From the aforementioned description of the preferred embodiment, it is apparent that the seat frame 2, the backrest 3, the front leg 5, and the rear leg 4, which are provided with different widths that increase in an order according to the present invention and which are interconnected through the pivot units 34, 44, 54, 63, can be laid on the same plane when the chair assembly 100 is folded, thereby achieving the purpose of minimizing the packaging materials, the transportation costs, and the storage space.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable chair assembly comprising:

a seat frame including left and right side sections and having a first width measured in a direction transverse to said left and right side sections;

a backrest including left and right side sections which are pivoted respectively to said left and right side sections of said seat frame, said backrest having a second width measured in a direction transverse to said left and right side sections of said backrest;

a rear leg including left and right side sections which are pivoted respectively to said left and right side sections of said backrest, said rear leg having a third width measured in a direction transverse to said left and right side sections of said rear leg;

a front leg including left and right side sections which are pivoted respectively to said left and right side sections of said rear leg and said left and right side sections of said seat frame, said front leg having a fourth width measured in a direction transverse to said left and right side sections of said front leg;

a pair of pivot units, each of which interconnects one of said left and right side sections of said backrest and one of said left and right side sections of said rear leg; and two connecting units, each of which includes a pivot portion connected between a respective one of said left and right side sections of said seat frame and a respective one of said left and right side sections of said front leg, and a connecting plate connected to said pivot portion and having an elongated slot to permit one of said pivot units to extend therethrough and to slide therewithin;

wherein when said chair assembly is folded, said seat frame, said backrest, and said front and rear legs lie substantially in the same plane.

2. The foldable chair assembly as claimed in claim 1, wherein said second width is greater than said first width, said third width being greater than said second width, said fourth width being greater than said third width, and wherein, when said chair assembly is folded, said seat frame extends within said backrest, said backrest extends within said rear leg, and said rear leg extends within said front leg.

3. The foldable chair assembly as claimed in claim 1, further comprising two pairs of cushion pieces, each of said pairs of said cushion pieces being mounted on one of said pivot units on two sides of said connecting plate of a respective one of said connecting units.

4. The foldable chair assembly as claimed in claim 1, wherein said left and right side sections of said seat frame have front and rear ends, said left and right side sections of said front leg having top and bottom ends, said rear ends of said left and right side sections of said seat frame being pivoted respectively to said top ends of said left and right side sections of said front leg through said pivot portions of said connecting units.

5. The foldable chair assembly as claimed in claim 4, wherein said left and right side sections of said backrest and said left and right side sections of said rear leg have top and bottom ends, said bottom ends of said left and right side sections of said backrest being pivoted respectively to said top ends of said left and right side sections of said rear leg.

6. The foldable chair assembly as claimed in claim 5, wherein said left and right side sections of said seat frame are pivoted respectively to said left and right side sections of said backrest above said top ends of said left and right side sections of said rear leg.

7. The foldable chair assembly as claimed in claim 6, wherein said left and right side sections of said backrest are pivoted respectively to said left and right side sections of said seat frame between said front and rear ends of said left and right side sections of said seat frame.

8. The foldable chair assembly as claimed in claim 7, wherein said left and right side sections of said front leg are pivoted respectively to said left and right side sections of said rear leg below said top ends of said left and right side sections of said front leg and below said top ends of said left and right side sections of said rear leg.

* * * * *